US006379273B1

(12) United States Patent
Takacs

(10) Patent No.: US 6,379,273 B1
(45) Date of Patent: Apr. 30, 2002

(54) GAMEBOARD, ESPECIALLY TABLEBOARD FOR BALL GAMES

(76) Inventor: Andrew Takacs, 99 Farms Rd. Cir., East Brunswick, NJ (US) 08816

( * ) Notice: Subject to any disclaimer, the term of this patent is extended or adjusted under 35 U.S.C. 154(b) by 0 days.

(21) Appl. No.: 09/509,930

(22) PCT Filed: Oct. 5, 1998

(86) PCT No.: PCT/IB98/01536

§ 371 Date: May 17, 2000

§ 102(e) Date: May 17, 2000

(87) PCT Pub. No.: WO99/17847

PCT Pub. Date: Apr. 15, 1999

(30) Foreign Application Priority Data

| | | |
|---|---|---|
| Oct. 6, 1997 | (HU) | 9701610 |
| Jan. 21, 1998 | (HU) | 9800104 |
| Apr. 3, 1998 | (HU) | 9800797 |

(51) Int. Cl.[7] ..... A63F 67/04
(52) U.S. Cl. ..... 473/496; 463/475; 463/473
(58) Field of Search ..... 473/474, 277, 473/422, 416, 496, 495, 475, 473; 477/475, 415, 465

(56) References Cited

U.S. PATENT DOCUMENTS 3,468,039 A * 9/1969 Dubbert
4,146,225 A * 3/1979 Hallet

FOREIGN PATENT DOCUMENTS

GB 0 029648 A1 * 6/1981

* cited by examiner

*Primary Examiner*—Benjamin H. Layno
*Assistant Examiner*—V K Mendiratta
(74) *Attorney, Agent, or Firm*—Ladas & Parry

(57) ABSTRACT

There is provided a gameboard, especially for playing table bull games, e.g. table tennis. The gameboard has playing surfaces (8, 9, 10) which touches the ball during play and a support frame (1) for supporting at least three playing surfaces (8, 9, 10) and placed on the floor (14), and further having an at least partly open playing field (13) formed by the playing surfaces (8, 9, 10), further having at least two playing surfaces (8, 9) inclined to the horizontal plane and an upper playing surface (10) positioned parallel to the floor and above the lower playing surface. The lower playing surfaces (8, 9) are connected to the support frame (1) in a manner fixable in different positions (31, 32, 33) or configurations relative to each other and the support frame (1), and thereby the playing surfaces (8, 9, 10) may be applicable for different play modes in the different positions (31, 32, 33) or configurations.

10 Claims, 8 Drawing Sheets

GAMEBOARD, ESPECIALLY TABLEBOARD FOR BALL GAMES

TECHNICAL FIELD

The present invention concerns a gameboard, especially for playing table ball games, e.g. table tennis, having a playing surface which touches the ball during play and a support frame supporting the playing surface and placed on the floor.

PRIOR ART

Traditional table ball games require relatively large play area, and therefor these games can not be played in smaller rooms or other places with a limited space. Numerous solutions have been suggested with the aim of creating versions of popular ball games that require only a small space to play. In most cases these games are only miniaturised versions of the traditional table ball games. Several solutions teaches the use of additional playing surfaces to limit the playing field, e.g. side plates, or an upper plate facing the lower playing surfaces.

Such games are described in the patent specifications U.S. Pat. No. 4,030,734, U.S. Pat. No. 5,178,385, and U.S. Pat. No. 3,891,210. A common disadvantage of the suggested solutions that they do not meet the demands raised by the modem age. Especially, either the games do not require substantially less space than the traditional table tennis, or the trajectory of the ball is very irregular, making it very difficult to follow the ball. This leads to reduced playing satisfaction.

A further game is disclosed in the document U.S. Pat. No. 4,334,681. Here, the players are standing on the same side of the playing field. The ball is rebounding from the playing field after multiple bounces. The space needed for the game have been reduced, but the players may disturb each other, and the ball is following an irregular path.

A gameboard for playing a game somewhat similar to table tennis is disclosed in the document WO 97/07863. This gameboard is provided with three playing surfaces which the ball touches during play. The playing surfaces define a partly open playing field. The gameboard also comprises a support frame supporting the playing surfaces and positionable on the floor, and the support frame has support means for supporting an upper playing surface in an essentially horizontal position and essentially above at least one lower playing surface. The two lower playing surfaces are in an inclined position relative to the floor, facing up and each other. This gameboard provides for a ball game where the trajectory of the ball makes a loop, rebounding once from each playing surface. Due to this loop, the overall length of the gameboard and the area around the gameboard which is required for playing may be reduced significantly, as compared with a standard table-tennis table. While the play with this gameboard have been found to provide good exercise in most cases, the gameboard can not be used for other playing modes, e. g. playing modes where the ball do not make a loop, or where only a single player intends to play or exercise with the gameboard. Also, some players found that the play is not fast enough.

Accordingly, it is the object of the present invention to eliminate at least some of the disadvantages of the known gameboards. In particular, it is sought to provide a game that requires fast play, hard exercise and increased rate of movement, but at the same time needs little play space, and may be played preferably in any apartment, and provides good entertainment and exercise. Also, it is the object of the invention to provide a game which eliminates at least some of the disadvantages of the known table games, and provides a well-defined ball trajectory in combination with a multiple-plane playing fields so that the following of the ball will be easy even after multiple reboundings from the playing surfaces.

SUMMARY OF THE INVENTION

According to the invention, the above objects are realised with a gameboard having a, at least two playing surfaces which the ball touches during play and which define a partly open playing field between them, b, a support frame supporting the playing surfaces and positionable on the floor, the support frame comprising c, support means for supporting i, an upper playing surface in an essentially horizontal position and essentially above at least one lower playing surface, and further ii, at least one lower playing, surface in an inclined position relative to the floor.

According to the invention, the support means is provided with means for supporting at least one lower playing surface in an inclined position where the playing surface is facing up and towards the support frame, and further the support means is provided with means for supporting at least one lower playing surface in an inclined position where the playing surface is facing up and away from the support frame.

In a preferred embodiment, the support means comprises a pair of lower support means for supporting at least one lower playing surface in the inclined position where the playing surface is facing up and towards the support frame, and further the support means comprises a pair of upper support means for supporting at least one lower playing surface in the inclined position where the playing surface is facing up and away from the support frame.

Advantageously, the support frame comprises a pair of lower support means and a pair of upper support means supporting the neighbouring sides of the two lower playing surfaces, where the playing surfaces present an A-shape when supported by the upper support means and the playing surfaces present a V-shape when supported by the lower support means.

Advantageously, the playing surfaces arranged in an A-shape or V-shape or horizontally are at least partly supported by a crossbar attached preferably perpendicularly to a leg part of the support frame.

In a further preferred embodiment, the lower playing surfaces arranged in A-shape are inclined with respect to the floor surface with an angle of 15–30 degrees, preferably 21 degrees, while the lower playing surfaces arranged in a V-shape are inclined with respect to the floor surface with an angle of 20–40 degrees, preferably 29 degrees.

By a further improvement, the inclination angle of at least one playing surface may be varied continuously or stepwise in the range of 10–80 degrees, preferably 20–40 degrees.

Preferably, the playing surfaces are foldable into a vertical position with respect to the plane of the floor. In this manner the gameboard occupies small space when not in use, and may be stored conveniently. Optionally, the playing surfaces and/or the support frame are constructed in a foldable and/or dismountable manner.

In a further preferred embodiment, the support frame comprises means for moving the lower and/or upper playing surfaces perpendicularly to the plane of the floor. This facilitates the use of the gameboard by persons being taller or smaller than the average, e.g. children.

Optionally, the gameboard may comprise a net limiting the playing field from the side of the leg parts of the support frame, and the playing surfaces may be provided with different markings, preferably with colour markings for dividing the playing surfaces and/or enhancing the edges of the playing surfaces.

With other words, there is provided a gameboard, especially for playing table ball games, e.g. table tennis, having a playing surface which touches the ball during play and a support frame for supporting at least three playing surfaces and placed on the floor, and further having an at least partly open playing field formed by the playing surfaces, further having at least two playing surfaces inclined to the horizontal plane and an upper playing surface positioned parallel to the floor and above the lower playing surface. According to the inventive concept, the lower playing surfaces are connected to the support frame in a manner fixable in different positions, and the playing surfaces are applicable for different play modes in the different positions.

Preferably the gameboard comprises two substantially equal sized lower playing surfaces, and further a support frame for supporting the lower playing surfaces in an A-shape or V-shape, with one side of the lower playing surfaces is adjacent to the other lower playing surface, and at least one of the lower playing surfaces is removably attached to the support frame. Thus the gameboard of the invention is conveniently adapted to different playing modes, by using the same basic elements, substantially without any extra costs. This is especially facilitated by the fact that the same lower playing surfaces are positioned in A-shape or V-shape. The varied playing modes are further enhanced if at least one of the lower playing surfaces is attached to the support frame with a variable inclination angle, at least in the position belonging to the A-shape.

The invention also relates to a support frame for a gameboard, especially for gameboards with playing surfaces for playing table ball games according to the invention. The support frame comprises support means for supporting at least three playing surfaces in a fixed position, the support means being adapted for supporting i, an upper playing surface in an essentially horizontal position and essentially above at least one lower playing surface, and further ii, at least one lower playing surface in an inclined position relative to the floor.

According to the invention, the support means is provided with means for supporting at least one lower playing surface in an inclined position where the playing surface is facing up and towards the support frame, and further the support means is provided with means for supporting at least one lower playing surface in an inclined position where the playing surface is facing up and away from the support frame.

With other words, the support frame comprises support means for keeping at least one lower playing surface in a position inclined to the horizontal plane, where two lower playing surfaces may be fixed in a first playing position are in an A-shape, and for keeping two lower playing surface fixed in a second playing position in a V-shape. As will be shown later, the support frame is also adapted for fixing one of the lower playing surfaces in a third, altenative playing position under the upper playing surface. The support frame of the invention is equally useful for supporting playing surfaces of other types of games, and thereby realising the gameboard of the invention. Therefor, it is advantageous if the support means is connecting at least one of the lower playing surfaces to the support frame in a removable manner.

It is also preferred if the support means connects at least one lower playing surface to the support frame with a variable inclination angle.

It is a further object of the invention to create a game which is especially suitable for single play, and requires a minimal space when not in use. This object may be also realised with the gameboard of the invention, using only one playing surface. In this case the lower playing surface is inclined to the horizontal with an angle of 20–40 degrees, preferably 29 degrees, and the upper playing surface is positioned horizontally The playing surfaces so positioned are especially suitable for playing or practicing by a single person. The ball trajectories are such that the ball will leave the playing field after only three bounces, and substantially in the same direction from which it arrived. Thereby the game is easier, and the ball rounds will be longer.

Advantageously, the support frame is formed as a wall mount. Optionally the support frame may further comprise a decorative or protecting plate.

As mentioned above, the support frame for the gameboard of the invention is provided with support means for fixedly positioning at least three playing surfaces. If only one lower playing surface is used, which is facing away from the support frame, it is preferred that the support means is fixing this lower playing surface inclined to the horizontal with an angle of 15–40 degrees, preferably 29 degrees, It has been found that with this inclination range the trajectories of the balls will be easy to follow, in spite of the fact that the ball is not visible for a short time when it is covered under the upper playing surface. The fact that the ball will return almost in the same direction from which it arrived makes it easier to return the ball even for players with little or no experience.

It is preferred if the support means connects at least one lower playing surface removably to the support frame. With an other embodiment, the support means connects at least one lower playing surface to the support frame with a variable inclination angle.

It has been found practical if the support means are formed as support bars or suspension bars. With an especially advantageous embodiment, the support frame is formed as a wall mount, and the lower playing surface is inclined outwards from the wall.

BRIEF DESCRIPTION OF DRAWINGS

By way of example only, various embodiments of the invention will now be described with reference to the accompanying drawings, in which.

BEST MODE FOR CARRYING OUT THE INVENTION

Figure 1:
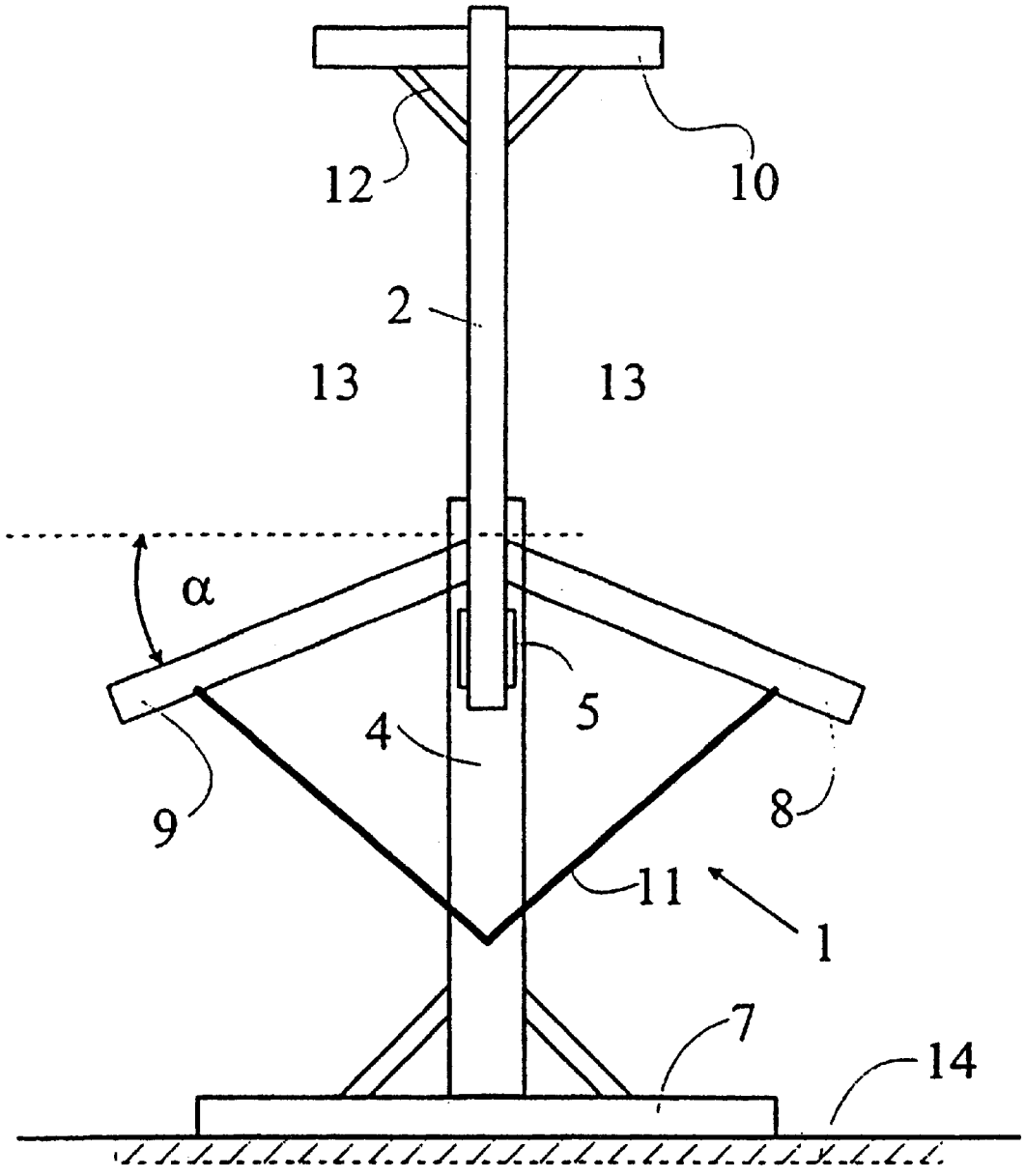
FIG. 1 is a side view of a first embodiment of a gameboard according to the invention.
Figure 2:
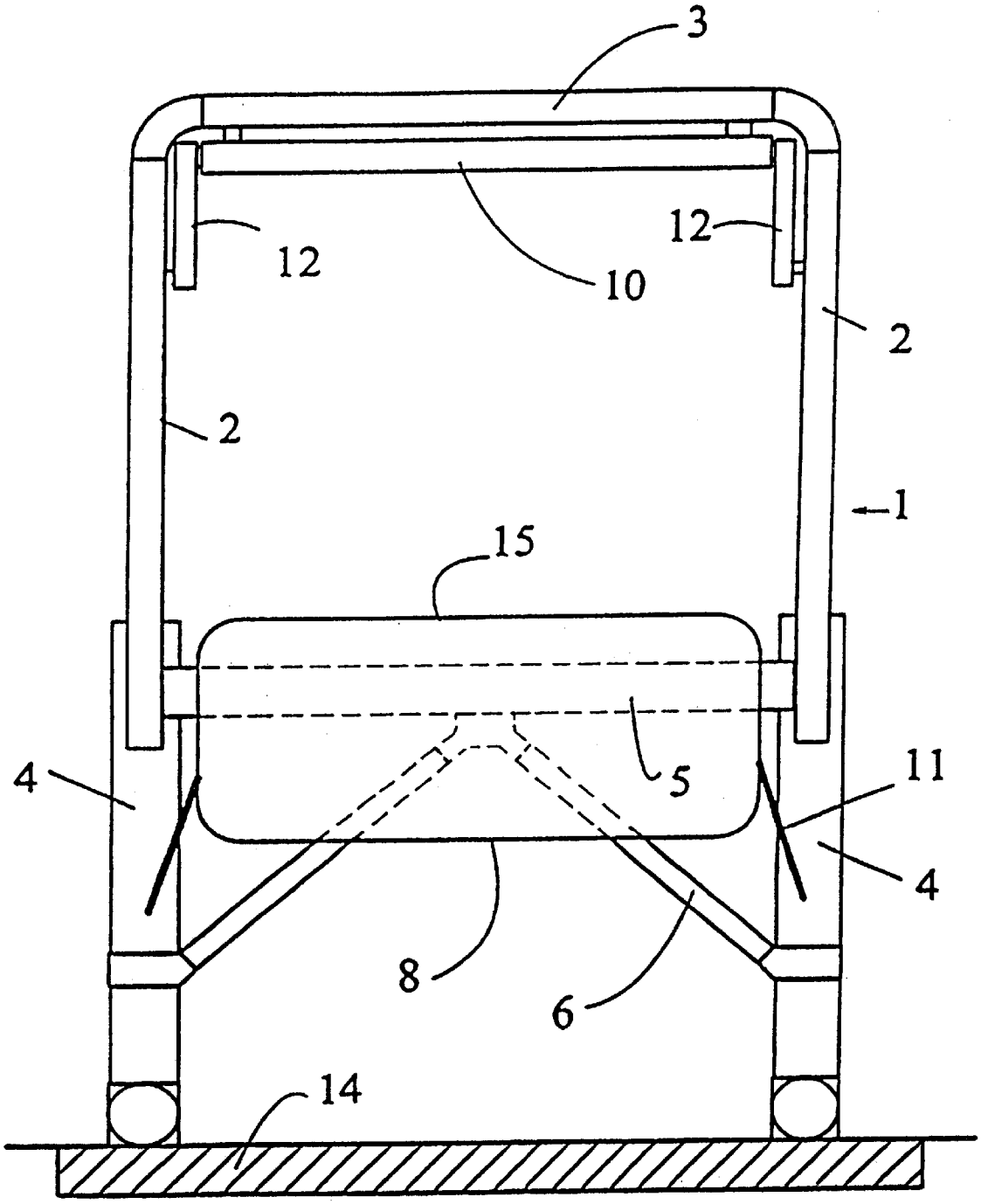
FIG. 2 is a front view of the gameboard of FIG. 1.

With reference to FIGS. 1 and 2, the gameboard of the invention is essentially a means for playing a table ball game. As seen on FIG. 1 and 2, the gameboard has a support frame 1, which comprises two horizontal foot parts 7 resting on the surface of the floor 14, and further comprises lower leg parts 2 and upper leg parts 4 perpendicular to the foot parts 7. The support frame 1 supports the playing surfaces 8,9,10. The playing surfaces 8,9,10 partly limit the playing field 13, from the top and bottom sides. The playing surfaces 8 and 9 have an equal size while the size of the upper playing surface 10 may be different from the lower playing surfaces 8 and 9.

The support frame 1 further comprises connecting braces 6 between the lower legs 4 and the lower crossbar 5 connecting the lower legs 4. The braces 6 increase the stability of the gameboard of the invention. As it is seen in FIG. 2 portions of the braces 6 and crossbar 5 are indicated by a dotted line only, because in this view the playing surface 8 would cover these portions of the lower crossbar 5 and the upper part of the braces 6.

The playing surfaces 8 and 9 are fixed to the crossbar 5 of the support frame 1, and arranged in an A-shape, i.e. the playing surfaces 8 and 9 are tilting toward each other with their upper horizontal edge 15, and these edges 15 are adjacent to each other. The fixing of the playing surfaces 8 and 9 arranged in a A-shape may be a rigid fixation. In this case the playing surfaces 8 and 9 are always fixed in a given position. Alternatively, the fixation may be with a hinge or joint, and thus the playing surfaces 8 and 9 may be moved out of the A-shape, and closed towards each other, by folding them either up or down. The playing surfaces 8 and 9 are inclined with respect to the floor surface 14 with an angle a of 15–30 degrees, preferably 20–25, in the present embodiment 21 degrees. The playing surfaces 8 and 9 are further locked in position through support elements 11 connected to the side of the lower playing surfaces 8 and 9 and to the lower leg parts 4 of the support frame 1. A wooden plate constituting the upper playing surface 10 is connected to the lower part of the upper crossbar 3, which latter connects the upper leg parts 2 and is arranged parallel to the floor.

The lower leg parts 4 connected to the foot parts 7 of the support frame 1 are movable in a direction perpendicular to the foot parts 7 with a predetermined amount, so the lower playing surfaces 8 and 9 forming an A-shape may be raised or lowered. Essentially, the lower and upper leg parts 4 and 2 of the support frame 1 are equipped with e.g. telescopic or similar mechanism (not shown), so that the third, upper playing surface 10 may be moved (raised or lowered) relative to the floor surface 14 or to the lower playing surfaces 8 and 9, so the open playing field 13 between the playing surfaces 8,9 and 10 is variable between predetermined dimensions. Thereby the playing field 13 may be adjusted to players with different height, e.g. children.

The support frame 1 further comprises adjustment means 12, with the help of which the upper playing field 10 is movable in a direction parallel to the floor surface 14. This movement is of significance during the application of the gameboard as a single-play gameboard, because in this version, as will be shown later with reference to FIG. 6, the upper playing surface 10 may be slightly translated sidewards for better covering the single lower playing surface.

The play is determined by the position of the three playing surfaces 8,9,10 relative to each other. As mentioned above, the board planes constituting the lower playing surfaces 8 and 9 arranged in A-shape are of equal size. The connecting edges of the playing surfaces 8 and 9 are raised 80–130 cm above the floor surface, preferably 95 cm. The lower playing surfaces 8 and 9 are inclined with respect to the floor surface preferably 21 degrees. As will be shown later, this angle $\alpha$ varies in the different configurations of the playing surfaces.

The height of the playing surface 10 above the floor surface 14 is between 168–180 cm, preferably 175 cm.

The plates of the playing surfaces 8, 9 and 10 are provided with colour markings, e.g. the playing surfaces 8 and 9 are painted green or blue, with white stripes on the sides and edges, and the playing surfaces are divided in four parts with similar white stripes. The lower part of the playing surface 10 is white, in order to provide more light in the playing field 13.

Use of the gameboard of the invention is described below. It must be noted that the gameboard of the invention is equally suited for individual play as well as for the concurrent play of more players. The gameboard is adequate for playing a ball game resembling mostly with table tennis.

The rules of the game are also based on the rules of traditional table tennis, that is change of serve after every 5 points and one set ends with 21 points. Of course, the game may be played according to other similar or totally different rules as well. It is understood that the rules of the game are not a part of the inventive concept, and may be chosen freely by the players.

There is an important difference as compared with table tennis, namely that with the gameboard of the invention has no net dividing the playing surface into two halves. It must be noted that a net may also be applied to the gameboard of the invention, but the role and placement of the net is very different from that of the net used in traditional table tennis. As an example, here the net may be used for preventing the balls from flying out of the playing field, if they are moving in the wrong direction. For this reason the net may be fastened to the support frame 1, or to its 2 and 4 upper and lower leg parts, and the sides of the playing surfaces.

Returning to the use of the gameboard of the invention, the ball must touch each playing surface once in every turn of the game. Thus the player serving the ball hits first with the ball 30 the playing surface in the A-shape closer to him or her, in such a manner that the ball 30 consequently jumps to the upper playing surface 10, and from there it rebounds to the playing surface in the A-shape further away from him or her and from there it bounces towards the other player. The other player must than hit the ball in a manner that the ball should again touch all three playing surfaces 8,9 and 10 as described above, but in reverse order.

The player who is not able to hit the ball back or the ball does not bounce back according to the rules, i.e. the ball does not touch all three playing surfaces, loses the point.

Figure 6:
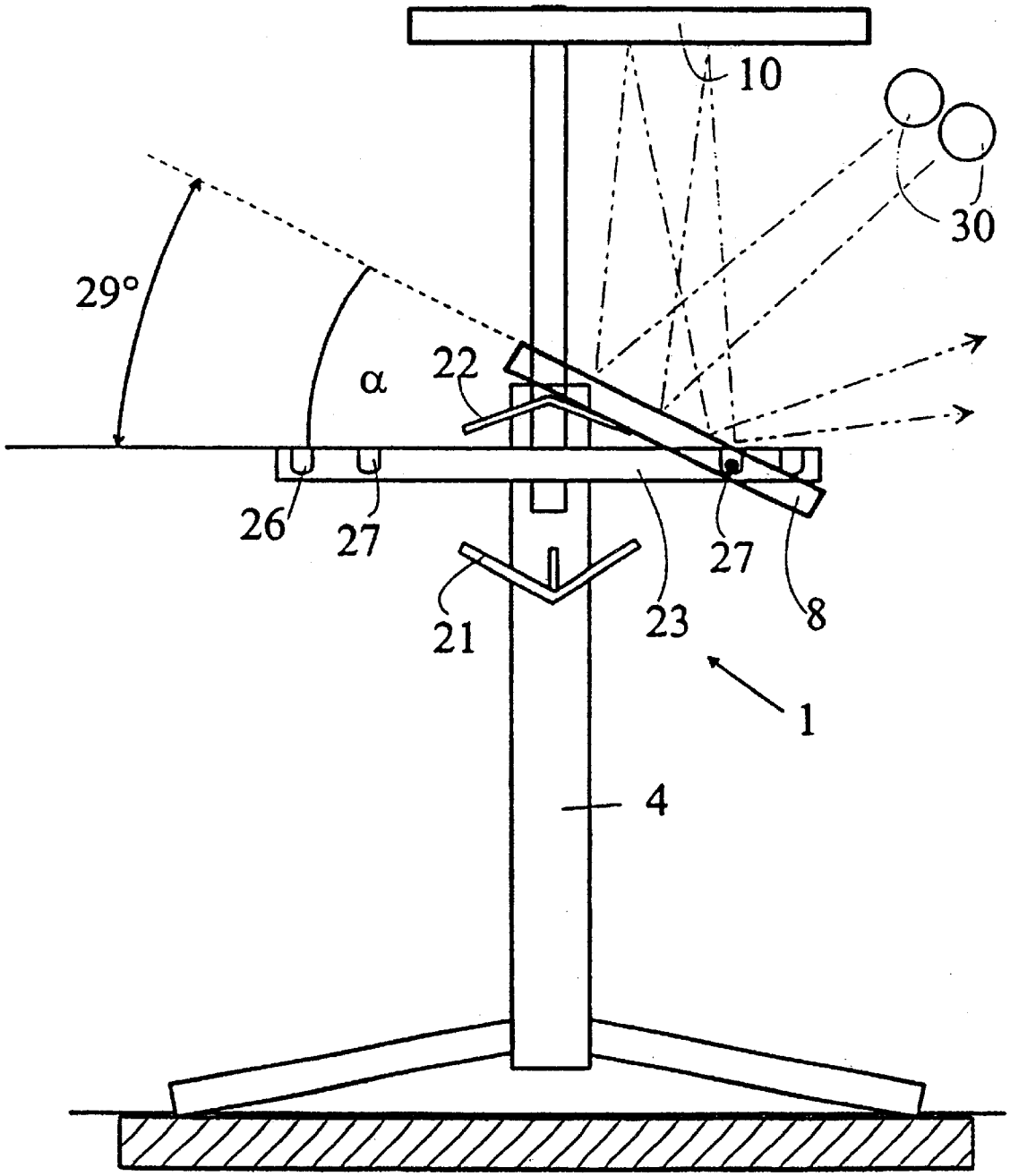
FIG. 6 is showing the embodiment of FIG. 3 with the lower playing surfaces in an alternative position, for single play.

The gameboard also may be used by one person only, for practice or just for fun. This variation of the gameboard is shown in FIG. 6. In this case one of the two lower playing surfaces 8 or 9 is removed, and as seen in FIG. 6, the remaining playing surface 8 or 9 is slightly more tilted to form an alternative playing surface configuration. Optionally, the other lower playing surface 8 or 9 may be turned completely vertical, practically in the plane of the foot part 2, so that the balls may rebound from it towards the player. It must be noted, though, that this vertical plate serves mostly as a decoration or protective plate, and is not touched by the ball in the regular play.

Figure 3:
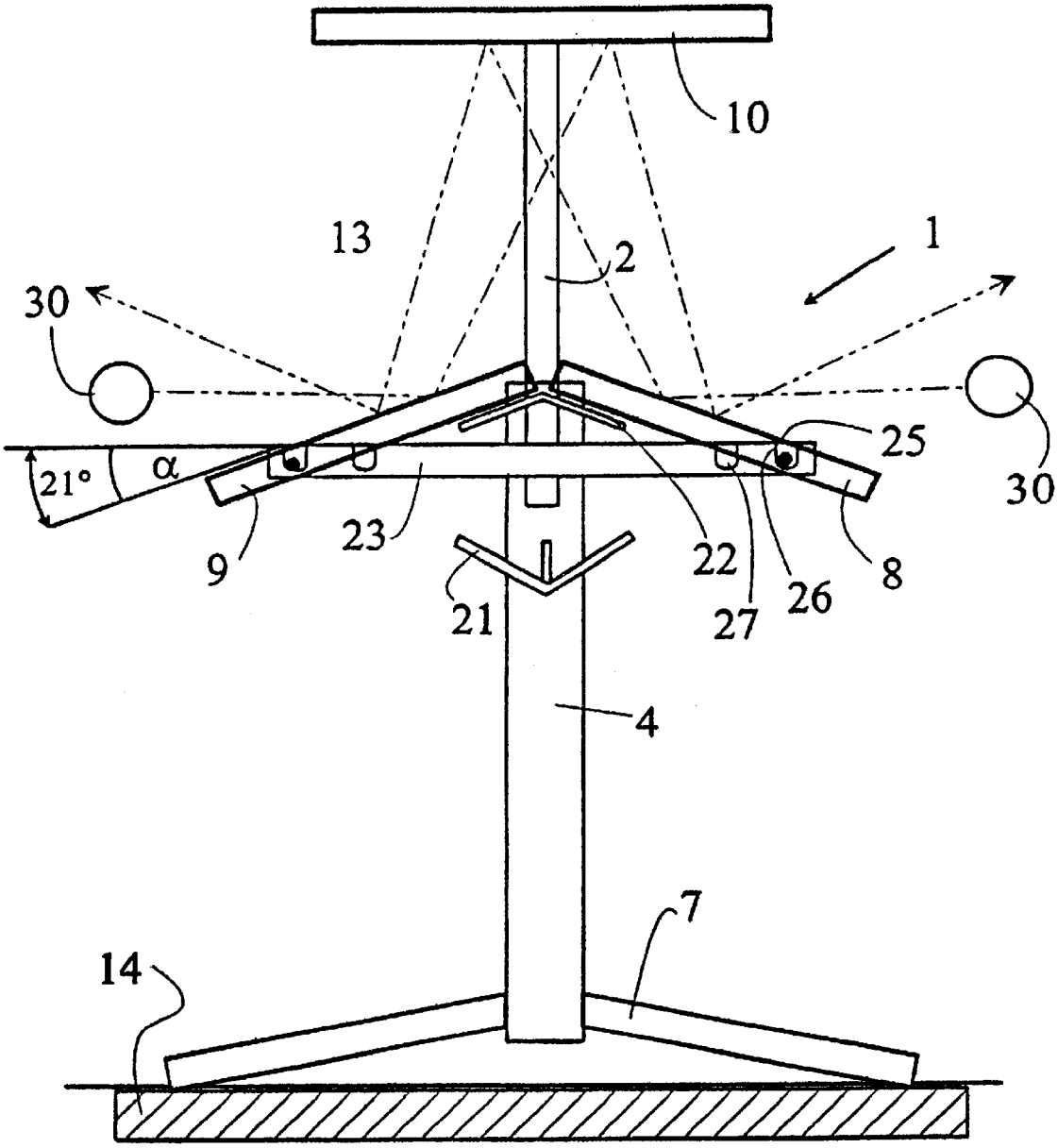
FIG. 3 is a side view of a second embodiment of a gameboard according to the invention.

FIG. 3 shows an especially preferred embodiment of the gameboard of the invention. Here the support frame 1 is provided with first fixing means for holding the playing surfaces 8 and 9 in a stable but removable position. The first fixing means of the support frame 1 comprise on both sides of the support frame 1 an upper support means 22, a lower support means 21, and grooves 26 and 27 formed in a crossbar 23, which is fastened perpendicularly to the support frame 1. The foot part 7 is slightly angled, so it is supported on the ends. The outward ends of the playing fields 8 and 9 are supported by the crossbar 23, with the help of the second fixing means 24. The second fixing means 24 comprise side pins 25, which rest in grooves 26 formed in the crossbars 23, and thereby ensure a stable, but easily removable fixation or fastening for the playing surfaces 8 and 9. The adjacent ends of the playing surfaces 8 and 9 are supported by the upper support means 22. The downwards or sidewards gliding of the playing surfaces are prevented by the connection of the side pins 25 and grooves 26. In this configuration the playing surfaces 8 and 9 are inclined to the horizontal with an angle $\alpha$ of 21 degrees. Naturally, other angles are also applicable, but experience showed that the best angle value is around 21 degrees. FIG. 3, also shows the possible trajectory of the ball 30.

Figure 4:
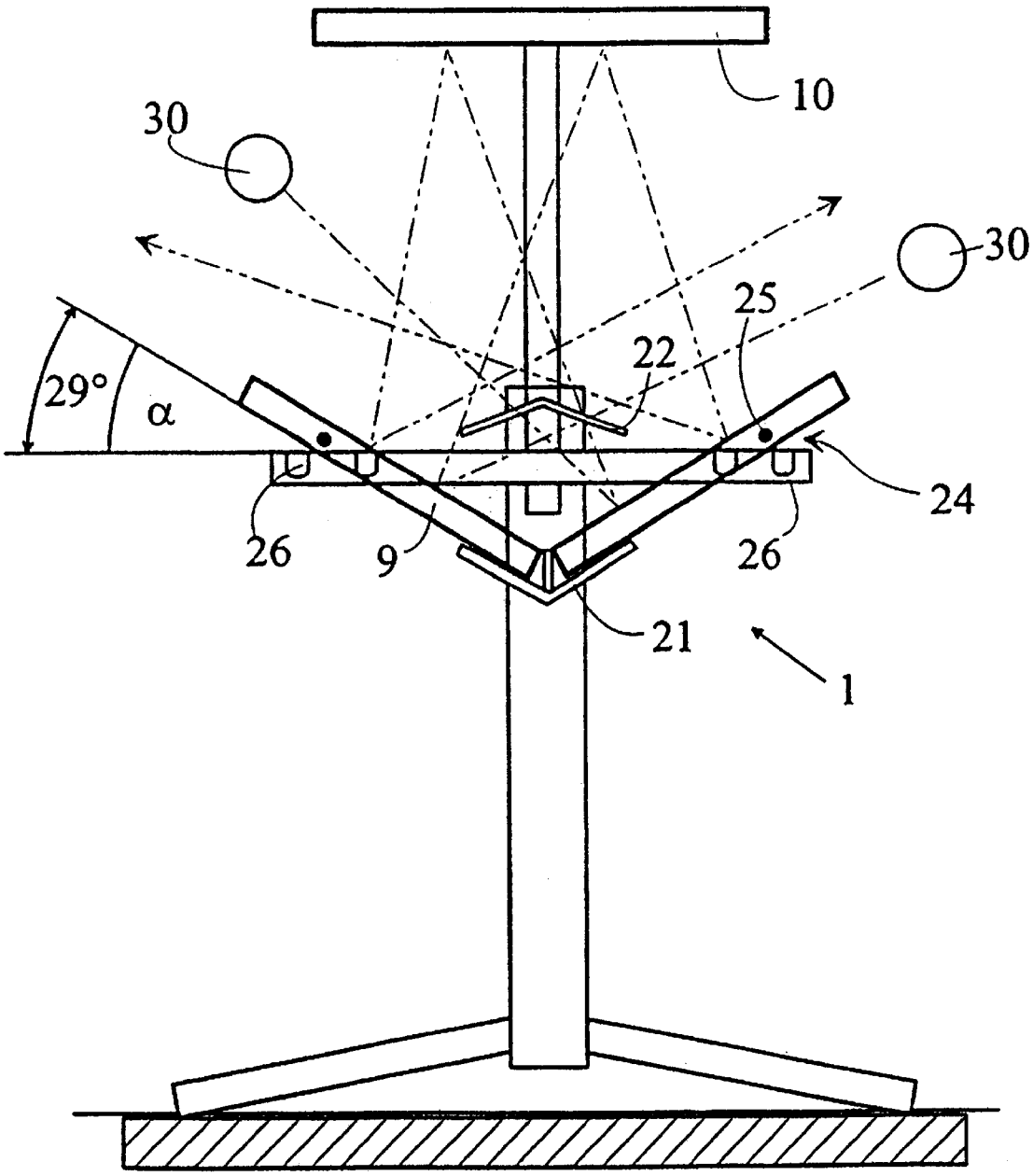
FIG. 4 is an embodiment of FIG. 3 with the lower playing surfaces in an alternative position.

FIG. 4 illustrates how the embodiment of FIG. 3 may be very easily transformed to a gameboard with an other playing configuration. In this case the playing surfaces 8 and 9 are supported by the lower support means 21 and the crossbar 23, and therefore they form a V-shape. In this situation the playing surfaces 8 and 9 arc inclined to the horizontal with an angle $\alpha$ of approx. 29 degrees. Here also the flight of the ball changes radically, and the trajectory will be as shown in FIG. 4, i.e. the ball 30 first hits the playing surface further from the player. Therefrom it bounces up to the upper playing surface 10, and bounces towards the other player via the surface closer to the starting player.

Figure 5:
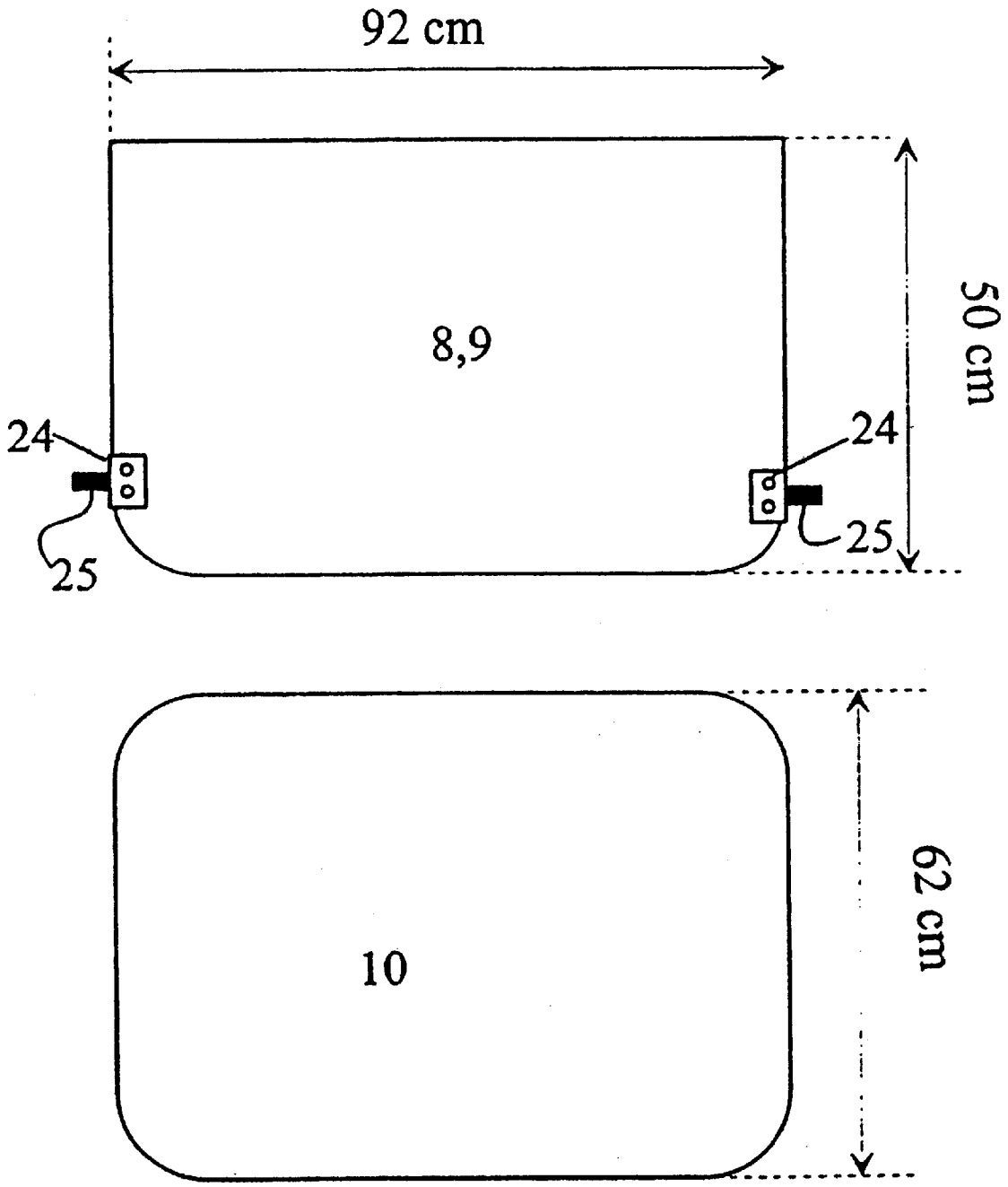
FIG. 5 shows the proposed shape and size of the playing surfaces of the gameboard of FIG. 3.

FIG. 5, shows the suggested size and shape of the playing surface. The second fixing means 24, here made as the side pin 25 and its fixing plate is also illustrated. As apparent from the figure, it is preferred to round off the free comers of the playing to surfaces, in order to improve the security of the play.

FIG. 6, shows the embodiment of the gameboard according to FIG. 3, configured to a further variant. In this case only two playing surfaces are utilised of the original three, in a configuration show in the figure. This configuration is best suited for a single person, either for play or exercise, because the ball 30 rebounds towards the same side from which it arrived into the playing field. As seen in FIG. 6, here one of the lower playing surfaces, presently the lower playing surface 8, is slightly more tilted than with the double play. A good practical value is 29 degrees. For this reason, the playing surface 8 is still supported by the upper support means 22, but the side pin 25 is moved from the groove 26 to the groove 27, which latter is closer to the leg part 4 of the support frame 1. Thereby the lower playing surface will be more tilted. A few possible ball trajectories are also shown. It must be noted that in this configuration the upper playing surface 10 is moved from the symmetric position more closer to the player (in FIG. 6 it is to the right side), in order to better cover the single lower playing surface 8.

Figure 7:
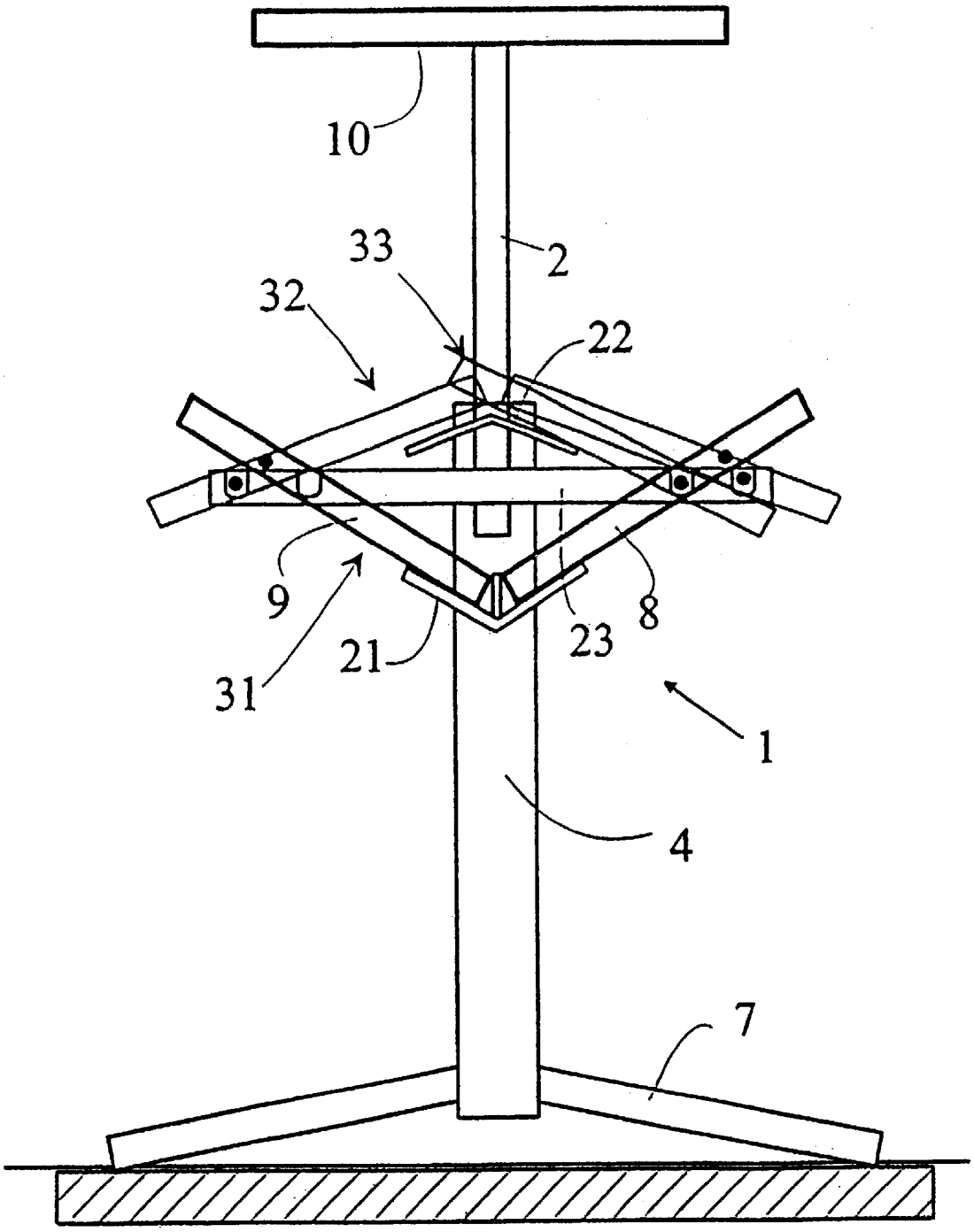
FIG. 7 shows on the same drawing the different positions of the the embodiment of FIG. 3, for easier comparison with each other, and finally

FIG. 7, shows the three possible positions or configurations together. In the position 31 the lower playing surfaces are in the A-shape, while in the position 32 the lower playing surfaces are in the V-shape. Position 33 needs only two playing surfaces, and it is mainly used for single play. It is apparent that the gameboard of the invention in combination with the support frame of the invention allow varied play and physical exercise for several or just one player, with minimal space and equipment needed.

Of course, not only these three configurations may be realised with the gameboard of the invention. There is nothing in the way for positioning the playing surfaces 8 and 9 completely horizontally on the crossbar 23, with or without further support means or fixing means, and thereby using the gameboard of the invention for other games in a known manner.

Figure 8:
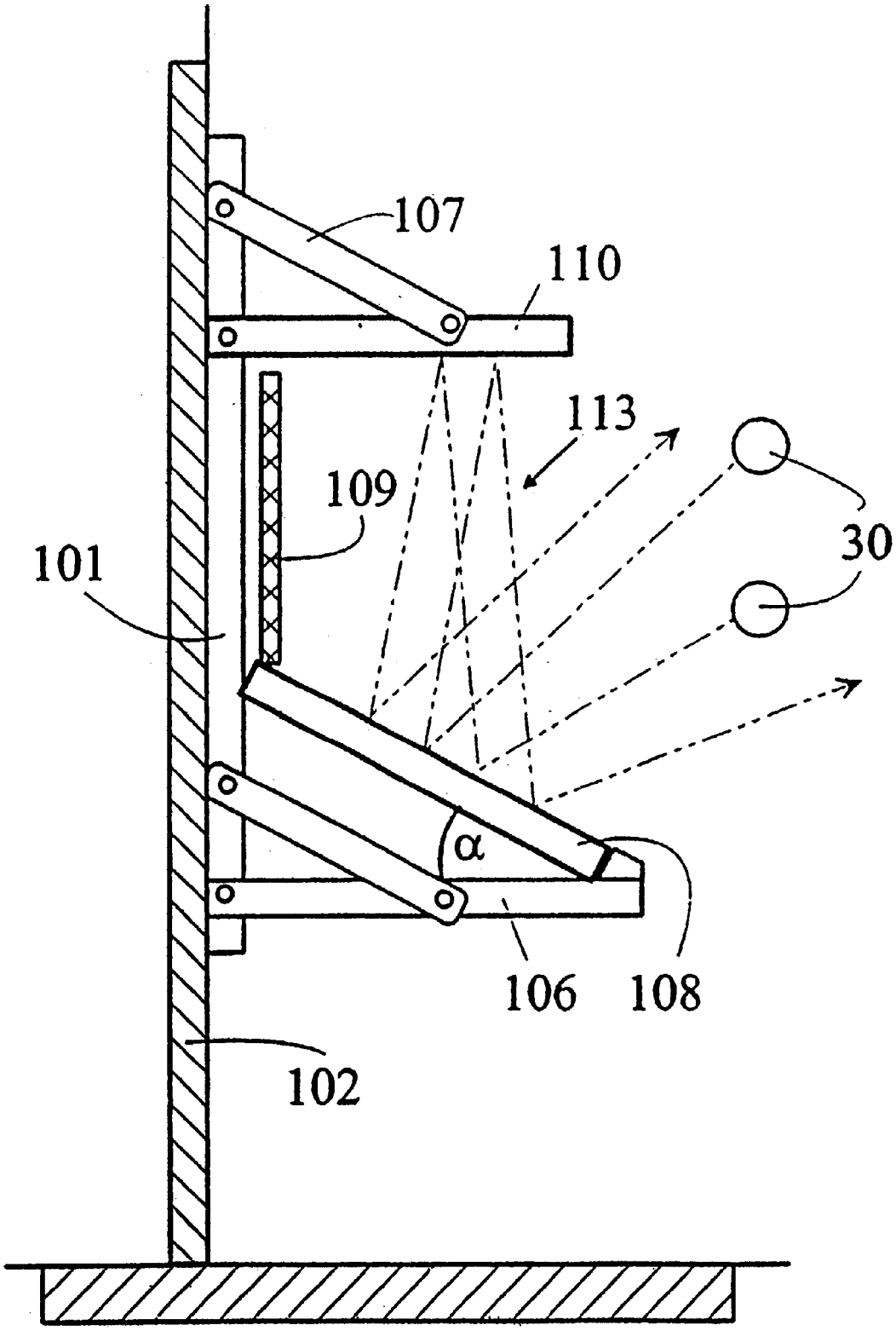
FIG. 8 is a third embodiment of the gameboard and support frame of the invention, in a wall mount version.

FIG. 8 depicts another modified embodiment of the gameboard according to the invention. With this gameboard only two playing surfaces are needed, and their special position guarantee the appropriate ball rounds. This modified embodiment corresponds substantially to the embodiment shown in FIG. 6, but uses a modified support frame 101. Generally, this modified gameboard according to the invention consist of the support frame 101 and of the two playing surfaces 108 and 110, which enclose at least partly the playing field 113. The size of the playing surfaces 108 and 110 may be different from each other.

The support frame 101 further comprise the stabilizing lower support bars 106, which support the lower playing surface 108. Similarly, the upper playing surface 110 is held by the upper suspension bars 107. In the shown embodiment the support frame 101 is formed as a wall mount, fixed to the wall 102. It is understood that the support frame 101 may be constructed as a self-supporting structure as well.

The playing surfaces 108 and 110 are thus fastened to the support frame 101. The fastening of the playing surface may be rigid, i.e. the playing surface 108 is always fixed in predetermined position, or may be hinged, so that the playing surface 108 may be folded up. The playing surface 108 is inclined to the horizontal with an angle $\alpha$ of 15 to 45 degrees, preferably 28–30 degrees, in the present embodiment 29 degrees. The 101 support frame is also comprising a protecting plate 109, which protects the wall 102 from the bouncing balls 30, but serves decorating purposes as well.

The play is determined by the relative position of the two playing surfaces 108 and 110. The higher edge of the playing surface 108 is approx. 70–80 cm, preferably 75 high above the floor 114, and is closer to the wall 102. With other words, the playing surface 108 is tilting towards the player, or towards the direction from which the ball 30 is directed towards the playing field 113.

The distance of the upper playing surface 110 from the floor may vary between 110 and 150 cm, it is preferably 125 cm. cm. The surfaces are inclined with respect to the floor Ace preferably 21 degrees.

The height of the playing surface 10 above the floor surface 14 is between 168–180 cm, preferably 175 cm.

The plates of the playing surfaces 108 and 110 are provided with colour markings, e.g. the playing surface 108 is painted green or blue, with white stripes on the sides and edges, and the playing surface is divided into parts with similar white stripes. The lower part of the playing surface 110 is white, in order to provide more light in the playing field 113.

Turning now to the use of the modified gameboard of the invention, the ball 30 must touch three times the playing surfaces once in every turn of the game, quite similar to that described with reference to FIG. 6. Thus the player serving the ball hits first with the ball the playing surface in such a manner, that the ball consequently jumps to the upper playing surface 110, and from there it rebounds to the playing surface 108 and from there it bounces out of the playing field 113, substantially in the direction from which it arrived. The other player must than hit the ball in a manner that the ball should again touch both playing surfaces 108 and 110 as described above, in the same order. For better illustration, two possible trajectories of the ball 30 is also depicted in FIG. 8.

Though FIG. 8 shows an especially advantageous embodiment of the gameboard according to the invention, it is understood that different embodiments are also possible within the scope of the invention. Presently the upper suspension bars 107 holding the playing surface 110 are situated on the two sides of the support frame 101. The lower playing surface 108 rests on the lower support bars 106. Otherwise both playing surfaces are removable, e.g. the lower playing surface 108 may be transformed into a table, or both the lower and upper plates can be folded onto the wall. Optionally the complete support frame 101 may be constructed so that it is easily removed from the wall 102.

Generally, this version of the gameboard according to the invention is very suitable for playing or exercising by only one person, because the ball 30 returns in the same direction from which it was thrown or hit into the playing field 113.

There is nothing in the way for positioning the playing surface 108 completely horizontally on the support bars 106 with or without further support means, and thereby using the gameboard of the invention for other games or other purposes in a known manner.

Generally, the gameboard of the invention offers the following advantages:

provides fast playing rhythm, forces the players to hard exercise, provides good workout for the muscles, improves reflexes, takes little space, and provides varied play.

The gameboard of the invention is not limited to the preferred embodiments illustrated in the drawings and the specification, but may be used for other "games in space" with minor and simple modifications.

What is claimed is:

1. A gameboard comprising:

a) an upper playing surface and a plurality of lower playing surfaces, each of said upper and lower playing surfaces being planar, said upper and lower playing surfaces defining between them a partly open playing field, the gameboard allowing players to stand on opposite sides of the game board while requiring only limited room;

b) a support frame supporting the playing surfaces and positionable on a floor, the support frame comprising support means for supporting the upper playing surface in an essentially horizontal position and essentially above the plurality of lower playing surfaces and for supporting the plurality of lower playing surfaces in any of a plurality of inclined positions relative to the floor, including a first inclined position in which at least one of the lower playing surfaces is facing up and towards the support frame and a second inclined position in which the at least one lower playing surface is facing up and away from the support frame.

2. The gameboard according to claim 1, wherein the support means comprises lower support means for supporting the at least one lower playing surface in the first inclined position with the playing surface facing up and towards the support frame and upper support means for supporting the at least one lower playing surface in the second inclined position with the at least one lower playing surface facing up and away from the support frame.

3. The gameboard according to claim 2, wherein the lower playing surfaces are supportable by the upper support means in an A-shape and are supportable by the lower support means in a V-shape.

4. The gameboard according to claim 3, wherein the support means comprises a support bar that at least partly supports the lower playing surfaces in the A-shape or V-shape.

5. The gameboard according to claim 3, wherein the lower playing surfaces are supportable by the upper support means in the A-shape with the lower playing surfaces inclined at an angle of 15–30 degrees with respect to the floor, and the lower playing surfaces are supportable by the lower support means in the V-shape with the lower playing surfaces inclined at an angle of 20–40 degrees with respect to the floor.

6. The gameboard according to claim 1, comprising further support means for supporting respective ends of the lower playing surfaces that are removed from the support frame.

7. The gameboard according to claim 1, wherein the lower playing surfaces are foldable into a substantially vertical position with respect to the floor.

8. The gameboard according to claim 1, wherein the upper and lower playing surfaces, the support frame or both are foldable or dismountable or both.

9. The gameboard according to claim 1, wherein the support frame comprises means for moving the lower playing surfaces, the upper playing surface, or both in a substantially perpendicular direction relative to the floor.

10. The gameboard according to claim 1, wherein the upper and lower playing surfaces comprise a plurality of different markings for demarcating the playing surfaces, enhancing edges of the playing surfaces or both.

* * * * *